US005353671A

United States Patent [19]

Inoue et al.

[11] Patent Number: 5,353,671

[45] Date of Patent: Oct. 11, 1994

[54] UPRIGHT PIANO WITH KEY ACTION MECHANISM RESPONSIVE TO REPETITION WITHOUT DOUBLE STRIKE AND LOSS OF SOUND

[75] Inventors: Satoshi Inoue; Hajime Hayashida, both of Shizuoka, Japan

[73] Assignee: Yamaha Corporation, Hamamatsu, Japan

[21] Appl. No.: 111,289

[22] Filed: Aug. 24, 1993

[30] Foreign Application Priority Data

Aug. 31, 1992 [JP] Japan ..... 4-255642

[51] Int. Cl.[5] ..... G10C 3/18

[52] U.S. Cl. ..... 84/236; 84/240; 84/243

[58] Field of Search ..... 84/219, 221, 222, 236, 84/240, 243

[56] References Cited

U.S. PATENT DOCUMENTS 4,854,211 8/1989 Tanaka et al. ..... 84/240
4,860,626 8/1989 Tanaka et al. ..... 84/236
4,879,939 11/1989 Wall ..... 84/240
4,896,577 1/1990 Trivelas et al. ..... 84/240
5,042,354 8/1991 Trivelas et al. ..... 84/240
5,272,950 12/1993 Petersen ..... 84/236

FOREIGN PATENT DOCUMENTS 57-30791 2/1982 Japan .

*Primary Examiner*—David M. Gray
*Assistant Examiner*—Eddie C. Lee
*Attorney, Agent, or Firm*—Graham & James

[57] ABSTRACT

A key action mechanism incorporated in an upright piano is accompanied with a repetition mechanism having a repetition lever rotatably supported by a butt and pushed by a jack after an escape from the butt for producing a gap between a leading end thereof and a back check, therefore, the butt and, accordingly, hammer assembly can rotate backwardly over a predetermined angle due to the gap, after the striking or after the escape of the jack, and, as a result, the hammer assembly is prevented from double-strike.

9 Claims, 9 Drawing Sheets

UPRIGHT PIANO WITH KEY ACTION MECHANISM RESPONSIVE TO REPETITION WITHOUT DOUBLE STRIKE AND LOSS OF SOUND

FIELD OF THE INVENTION

This invention relates to an upright piano and, more particularly, to a key action mechanism incorporated in the upright piano.

DESCRIPTION OF THE RELATED ART

A typical example of the key action mechanism is disclosed in Japanese Utility Model Application laid-open (Kokai) No. 57-30791, and the prior art key action mechanism disclosed therein aims at improvement of response characteristics to a repetition or a quick fingering such as tremolo.

The prior art key action mechanism is provided in association with a key and with a hammer assembly for striking a string, and a capstan button is upright at the rear end portion of the key. The prior art key action mechanism comprises a whippen assembly swingably supported by a stationary action rail and upwardly pushed by the capstan button, a jack swingably supported on the whippen assembly, a compression coil spring inserted between the whippen assembly and the toe of the jack, a butt rotatably supported by the stationary action rail and connected with the hammer assembly, a regulating button for defining a release of the jack, a catcher backwardly projecting from the butt, a back check projecting from the whippen assembly and opposed to the catcher, and a spring wire backwardly projecting from the butt. The butt is urged by a butt spring in a direction to space from the associated strings.

While the key is staying at a rest position, the compression coil spring allows the jack to stay to the initial position under the butt, and the toe of the jack is spaced apart from the regulating button, and the back check is also spaced apart from the catcher.

When a player depresses the key, the capstan button upwardly depresses the whippen assembly, and the whippen assembly is driven for rotation. As the jack is swingably supported on the whippen assembly, the jack pushes the butt with the rotation of the whippen assembly, and drives the butt and, accordingly, the hammer assembly for rotation toward the string. However, when the toe of the jack is brought into contact with the regulating button, the jack starts rotating to release from the butt, and kicks the butt. As a result, the hammer assembly rushes toward the string, and strikes the string for producing a piano sound.

The hammer assembly rebounds from the string, and backwardly rotates. The butt spring supplements the rotation of the hammer assembly. The catcher moves closer to the back check, and the spring wire is brought into contact with the top surface of the back check before the catcher is brought into contact with the back check. As the hammer assembly continues to rotate backwardly until it is checked by the back check, the spring wire is deformed, and the deformation causes the elastic force to urge the butt in the direction to the string. After the contact of the spring wire with the top surface of the back check, the catcher is brought into contact with the back check. As a result, when the key is slightly lifted and the catcher is released from the back check, the butt and, accordingly, the hammer assembly slightly advance toward the string. The elastic force caused by the spring wire slightly lifts the butt, and the butt thus lifted allows the jack to easily move thereunder. This means that the key action mechanism gets ready for response to the next key depressing, and the spring wire improves the response characteristics to the quick fingering.

However, the prior art key action mechanism thus arranged encounters various problems. First, when a player softly depresses the key producing a pianissimo sound, the hammer assembly rebounds from the string. Therefore, as the torque backwardly rotating the butt can not overcome the torque produced by the spring wire for urging the butt toward the string, the hammer assembly is liable to return without any contact between the back check and the catcher for striking the string again.

Another problem is the loss of a sound. Before the jack is released from the butt, the spring wire must be brought into contact with the top surface of the back check, so that the jack can return under the butt when the catcher is released from the back check due to the key slightly lifted. And elastic force caused by the spring wire is expected to be larger than that of the butt spring so as to slightly lift the butt. When the player depresses the key slowly, the back check is upwardly moved together with the whippen assembly, and pushes the spring wire upwardly after the jack is released from the butt, and, accordingly, the spring wire urges the butt toward the string. In this case, the elastic force of the spring wire causes the butt and, accordingly, the hammer assembly to rotate forcibly toward the string, and presses the hammer against the string. No vibration takes place on the string, and the expected sound is lost due to the hammer assembly pressed against the string.

Yet another problem is encountered in the prior art key action mechanism in regulating. In the regulating, especially, adjusting the regulating button for an ordinary acoustic piano, while a tuner is slowly depressing a key, the jack is released from the butt at a predetermined point, and the hammer slightly returns thereafter. At the timing when the hammer slightly returns, the tuner adjusts the distance between the hammer head and the string to a predetermined value. However, as described hereinbefore, the prior art key action mechanism is equipped with the spring wire, and the spring wire is still held in contact with the back check after the release of the jack. This means that the tuner can not discriminate the timing when the distance should be adjusted to the predetermined value, because the hammer urged toward the string by the spring wire, not by the jack, can not return slightly after the jack is released from the butt.

SUMMARY OF THE INVENTION

It is therefore an important object of the present invention to provide an upright piano which is free from the double-strike and the loss of a sound due to cling to the string and is easily regulated.

To accomplish the object, the present invention proposes to produce a gap between a leading end of the repetition lever and a back check by a rotation of the repetition lever due to an escape of a jack so that a hammer assembly can slightly rotate backwardly after the striking even if a key is depressed slowly, when the jack is escaped from the butt and before the butt rotates backwardly.

In accordance with the present invention, there is provided an upright piano comprising: a) a keyboard having at least one key swingable between a rest position without any force and an end position, a capstan button projecting from a rear end portion of the at least one key; b) at least one string associated with the at least one key; c) at least one hammer assembly for striking the at least one string; d) a key action mechanism linked with the at least one key for driving the at least one hammer assembly, and having d-1) a whippen assembly pivotaly supported by a stationary structure, and rotated by the capstan button between a first initial position corresponding to the rest position and a first terminal position corresponding to the end position through a first intermediate position, d-2) a jack pivotaly supported by the whippen assembly, and moved from a second initial position to a restricted position without any pivotal motion when the whippen assembly is swung from the first initial position to the first intermediate position, the jack being rotated around the whippen assembly from the restricted position through an escape position to a second terminal position when the whippen assembly is rotated from the first intermediate position to the first terminal position, d-3) a butt pivotaly supported by the stationary structure, and connected with the hammer assembly, the butt being rotated by the jack in a forward direction from a third initial position corresponding to the second initial position to a released position corresponding to the escape position, the butt being kicked by the jack at the released position for rushing the at least one hammer assembly toward the at least one string, the at least one hammer assembly rebounding on the at least one string so that the butt being rotated in a backward direction through a second intermediate position to a third terminal position, d-4) a back check projecting from the whippen assembly, and d-5) a catcher backwardly projecting from the butt, and brought into contact with the back check when the butt reaches the third terminal position; and e) a repetition mechanism having e-1) a repetition lever rotatably supported by the butt, and rotated by a jack due to the escape so as to produce a gap between a leading end thereof and the back check when the jack reaches the second terminal position and before the at least one hammer assembly rotates backwardly, then the leading end being brought into contact with the back check when the butt reaches the second intermediate position, e-2) a driving rod means projecting from the repetition lever, brought into contact with the jack, and rotating the repetition lever over the back check on the way from the escape position to the second terminal position by the jack rotation due to the escape, and e-3) an elastic means urging the repetition lever for allowing the driving rod means to be brought into contact with the jack.

BRIEF DESCRIPTION OF THE DRAWINGS

The features and advantages of the upright piano according to the present invention will be more clearly understood from the following description taken in conjunction with the accompanying drawings in which.

DESCRIPTION OF THE PREFERRED EMBODIMENTS

First Embodiment

Figure 1:
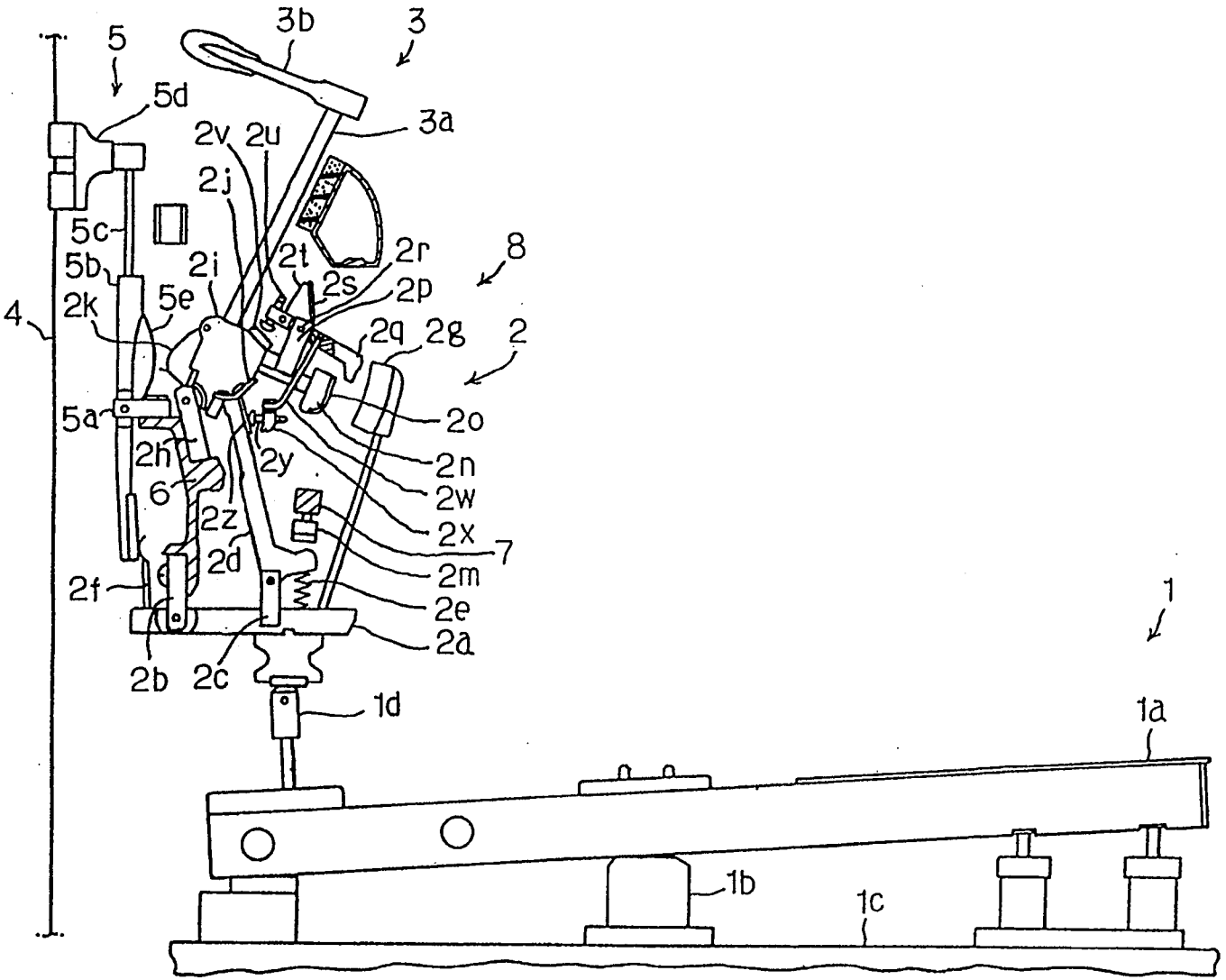
FIG. 1 is a side view showing essential parts of an upright piano according to the present invention while the key is staying in a rest position.

Referring first to FIG. 1 of the drawings, an upright piano embodying the present invention comprises a keyboard 1 having a plurality of black and white keys 1*a*, a balance rail 1*b* mounted on a key bed 1*c* and turnably supporting the black and white keys 1 a with respect to balance pins, and a capstan button 1*d* projecting from a rear end portion of each key 1*a*. Notes are assigned to the keys 1*a*, and a player instructs the upright piano to produce a sound with a note by depressing one of the keys 1*a*.

The upright piano further comprises a plurality of key action mechanisms 2 each associated with one of the black and white keys 1*a*, a plurality of hammer assemblies 3 respectively associated with the key action mechanisms 2 and each connected with the associated key action mechanism 2, strings 4 vertically stretched and respectively associated with the keys 1*a* and, accordingly, the hammer assemblies 3 and a plurality of damper assemblies 5 respectively associated with the strings 4. However, FIG. 1 illustrates only one of the keys 1*a* and the associated key action mechanism 2, hammer assembly 3, string 4 and damper assembly 5, and description is focused on the one set of key, key action mechanism, hammer assembly, the string and damper assembly. In the following description, terms "clockwise", "counter clockwise", "right" and "left" are determined on the paper where a related figure is drawn.

Figure 2:
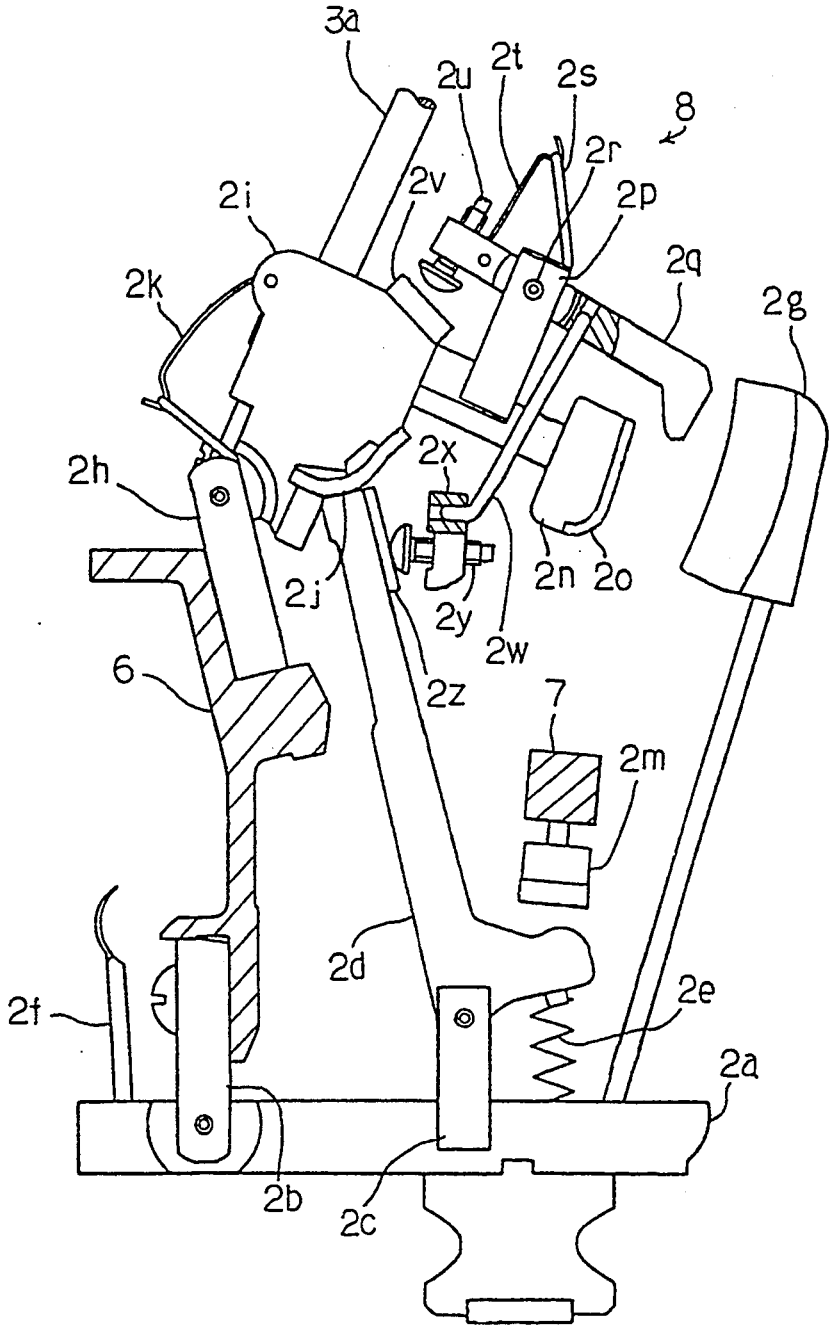
FIG. 2 is a partially cut-away side view showing, in an enlarged scale, a key action mechanism accompanied with a repetition mechanism shown in FIG. 1.

As will be better seen from FIG. 2, the key action mechanism 2 comprises a whippen/whippen heel assembly 2*a* held in contact with the pair of capstan buttons 1*d*, a whippen flange 2*b* connected with a center rail 6 and swingably supporting the whippen/whippen heel assembly 2*a*, a jack flange 2*c* fixed to the whippen/-whippen heel assembly 2*a* on the right side of the whippen flange 2*b*, a jack 2*d* rotatably supported by the jack flange 2*c*, a jack spring 2*e* urging the jack 2*d* in the counter clockwise direction, a damper spoon 2*f* projecting from the whippen/whippen heel assembly 2*a* on the left side of the whippen flange 2*b*, and a back check 2*g* projecting from the whippen/whippen heel assembly 2*a* on the right side of the jack flange 2*c*. The back check is fabricated from a back check wire projecting from the whippen/whippen heel assembly 2*a*, a back check block fixed to the upper end of the back check wire and a back check felt bonded to the back check block as similar to that of an ordinary acoustic piano.

The key action mechanism 2 further comprises a butt flange 2*h* fixed to the center rail 6, a butt 2*i* rotatably supported by the butt flange 2*h*, a butt skin 2*j* bonded to the lower surface of the right side portion of the butt 2*i*, a butt spring 2*k* urging the butt 2*i* in the clockwise direction, and a regulating button 2*m* downwardly projecting from a regulating rail 7 in opposing relation to a toe of the jack 2*d*. The hammer assembly 3 projects from the upper end of the butt 2*i*, and is rotatable together with the butt 2*i*. The jack 2*d* is held in contact with the butt skin 2*j*, and the toe of the jack 2*d* is spaced apart from a regulating button 2*m*. The regulating button 2*m* has a leather sheet where the toe of the jack 2*d* is brought into contact.

While the whippen/whippen heel assembly 2*a* is rotating in the counter clockwise direction due to the key 1*a*, not shown in FIG. 2, depressed, the jack 2*d* pushes the butt 2*i* for rotating in the counter clockwise direction, and the toe of the jack 2*d* is getting closer to the regulating button 2*m*. When the toe of the jack 2*d* is brought into contact with the regulating button 2*m*, the jack 2*d* starts to rotate in the clockwise direction, and the jack 2*d* is escaped from the butt skin 2*j* and kicks the butt 2*i* so that the hammer assembly 3 rushes toward the string 4.

The key action mechanism 2 further comprises a catcher 2*n* projecting from the right side surface of the butt 2*i*, and a catcher skin 2*o* bonded to the right side surface of the catcher 2*n* and opposed to the back check 2*g*. While the key 1*a* is staying in the rest position, the catcher skin 2*o* is spaced apart from the back check 2*g*. However, after the hammer assembly 3 strikes the string 4, the hammer assembly rebounds on the string 4, and the butt 2*i* rotates in the clockwise direction. The butt spring 2*k* urges the butt 2*i*, and the catcher 2*n* and the catcher skin 2*o* are moved toward the back check 2*g*. The catcher skin 2*o* is brought into contact with the back check 2*g*, and the back check 2*g* sets a limit on the rotation of the butt 2*i*.

The key action mechanism 2 thus arranged is accompanied with a repetition mechanism 8, and the repetition mechanism 8 comprises a flange 2*p* fixed to the butt 2*i*, a repetition lever 2*q* supported by the flange 2*p* and rotatable with respect to a pin 2*r* supported by the flange 2*p*, a cord 2*s* projecting from the upper surface of the flange 2*p*, a spring 2*t* coupled between the cord 2*s* and the repetition lever 2*q* for urging the repetition lever 2*q* in the clockwise direction, a regulating screw 2*u* screwed into the repetition lever 2*q* on the left side of the flange 2*p* and opposed to a butt cloth 2*v* bonded to the butt 2*i*, a rod member 2*w* snugly received in a hole formed in the repetition lever 2*q* on the right side of the flange 2*p*, a block member 2*x* fixed to the rod member 2*w*, and a regulating screw 2*y* screwed into the block member 2*x* and held in contact with a jack cloth 2*z* bonded to the jack 2*d*.

The regulating screw 2*y* is screwed into or out of the block member 2*x*, and changes the distance between the jack cloth 2*z* and the block member 2*x*. In other words, the regulating screw 2*y* changes the initial angle of the repetition lever 2*q*. If the screw 2*y* increases the distance, the rod member 2*w* pushes the repetition lever 2*q*, and causes the repetition lever 2*q* to rotate around the pin 2*r* in the counter clockwise direction. On the other hand, if the screw 2*y* is screwed into the block member 2*x*, the distance is decreased, and the repetition lever 2*q* rotates in the clockwise direction. Thus, the regulating screw 2*y* determines the initial angular position of the repetition lever 2*q*, and, therefore, regulates the distance between the semi-spherical portion of the repetition lever 2*q* and the top surface of the back check 2*g* when the escape of the jack 2*d* completes but before the rotation of the hammer assembly 3 in the clockwise direction. In other words, the regulating screw 2*y* determines the amount of backward motion of the hammer assembly 3 after the escape of the jack 2*d* when the key 1*a* is depressed slowly, as will be described hereinlater.

Turning back to FIG. 1, the hammer assembly 3 comprises a hammer shank 3*a* implanted into the butt 2*i* and a hammer head 3*b* supported by the hammer shank 3*a*. While the key 1*a* is staying in the rest position, the hammer head 3*b* is spaced apart from the string 4. However, the hammer head 3*b* strikes the string 4 when the key action mechanism 2 is driven by the key 1*a*.

The string 4 usually consists of three music wires, and vibrate for producing a sound with the note assigned to the associated key 1*a* upon a strike with the hammer head 3*b*.

The damper assembly 5 comprises a damper lever flange 5*a* fixed to the center rail 6, a damper lever 5*b* rotatably supported by the damper lever flange 5*a*, a damper wire 5*c* projecting from the damper lever 5*b*, and a damper head 5*d* fixed to the leading end of the damper wire 5*c*, and a damper spring 5*e* urges the damper lever 5*b* in the counter clockwise direction.

While the key 1*a* is staying in the rest position, the damper spoon 2*f* is spaced apart from the lower end portion of the damper lever 5*b*, and the damper head 5*d* is pressed against the string 4. However, if the damper spoon 2*f* declines toward the left side due to the key 1*a* depressed by the player, the damper spoon is brought into contact with the lower end portion of the damper lever 5*b* at the predetermined point, and, then, the damper lever 5*b* is driven for rotation in the clockwise direction, and leaves the damper head 5*d* from the string 4. After the key 1*a* is released, the damper assembly 5 returns to the initial position, and the damper head 5*d* takes up the vibrations of the string 4. Though not shown in the drawings, the upright piano according to the present invention is equipped with pedal mechanisms, and one of the pedal mechanisms is provided in association with the damper assembly 5 for holding off the damper head 5*d*.

Description is hereinbelow made on sequential motions of the upright piano. Assuming now that a player depresses the key 1*a*, the pair of capstan buttons 1*d* is upwardly moved, and pushes the whippen/whippen heel assembly 2*a* upwardly, and the whippen/whippen heel assembly 2*a* is driven for rotation in the counter clockwise direction around the whippen flange 2*b*. In the counter clockwise rotation, the jack 2*d* and the back check 2*g* are upwardly moved from the initial position together with the whippen/whippen heel assembly 2*a*, and the damper spoon 2*f* declines toward the left side.

The damper spoon 2*f* thus declining on the left side is brought into contact with the lower end portion of the damper lever 5*b* at the predetermined point and rotates the damper lever 5*b* in the clockwise direction around the damper flange 5*a*, and the damper head 5*d* is left from the string 4. As a result, the string 4 is ready for free vibrations.

The jack pushes the butt 2*i* until the toe of the jack 2*d* is brought into contact with the regulating button 2*m*, and rotates the butt 2*i* in the counter clockwise direction. While the jack 2*d* upwardly pushes the butt 2*i*, the butt cloth 2*v* is spaced from the regulating screw 2*u*.

However, when the toe of the jack 2*d* is brought into contact with the regulating button 2*m*, the jack 2*d* rotates around the jack flange 2*c* in the clockwise direction against the elastic force of the jack spring 2*e*, and the jack spring 2*e* is resiliently deformed. The jack 2*d* is finally escaped from the butt 2*i*, and the butt 2*i* is kicked by the jack 2*d*. The butt 2*i* thus kicked is driven for rotation in the counter clockwise direction, and the hammer assembly rushes toward the string 4. The hammer head 3*b* strikes the string 4, and the string 4 vibrates for producing a sound with the note assigned to the depressed key 1*a*.

Figure 3:
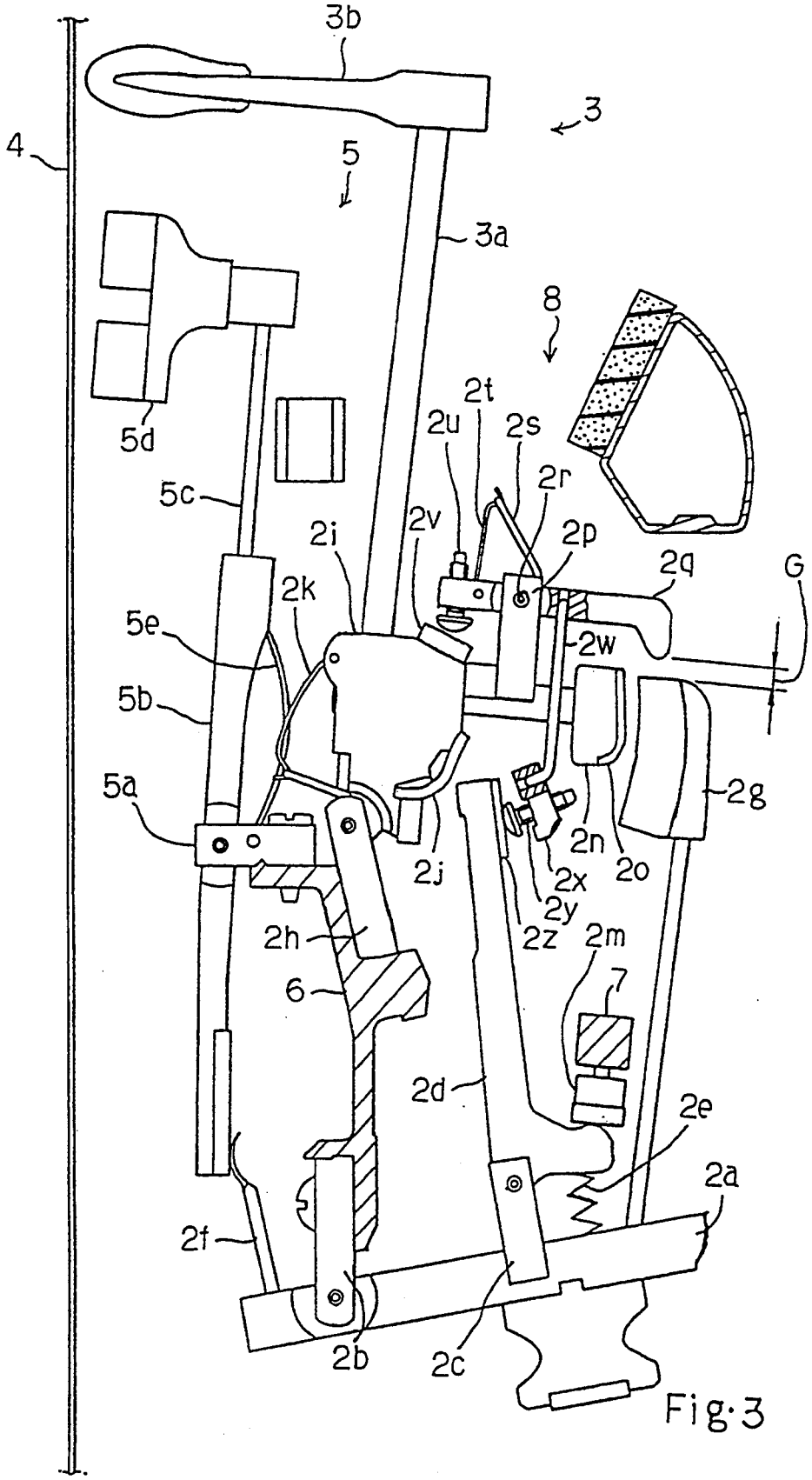
FIG. 3 is a side view showing the key action mechanism and the repetition mechanism when the jack is escaped from the butt.

On the other hand, the spring 2*t* keeps the head of the regulating screw 2*y* in contact with the jack cloth 2*z*. Therefore, the jack escaped from the butt urges the regulating screw 2*y* and, accordingly, the repetition lever 2*q* to rotate against the elastic force of the spring 2*u* in the counter clockwise direction without any contact with the back check felt, and the repetition lever 2*q* reaches a certain position over the back check felt as shown in FIG. 3. A gap G takes place between the top surface of the back check felt and the semi-spherical portion of the repetition lever 2*q*.

Even if the player softly depresses the key 1*a*, the hammer head 3*b* rebounds on the string 4, and is never pressed against the string 4. In other words, the hammer head 3*b* never terminates a pianissimo sound. Because the hammer assembly 3 can rotate in the clockwise direction due to the gap G, after the hammer head 3*b* strikes the strings 4, or after the escape of the jack 2*d* in the adjusting the regulating button 2*m*.

The hammer head 3*b* rebounds on the string 4, and the butt spring 2*k* urges the butt 2*i* to rotate in the clockwise direction, and the semi-spherical portion of the repetition lever 2*q* is brought into contact with the top of the back check felt of the back check 2*g* before the contact of the catcher skin 2*o* with the back check felt. Since the butt 2*i* and, accordingly, the hammer assembly 3 continues to rotate in the clockwise direction until it is checked by the back check 2*g*, the repetition lever 2*q* further rotates in the counter clockwise direction around the pin 2*r*.

Figure 4:
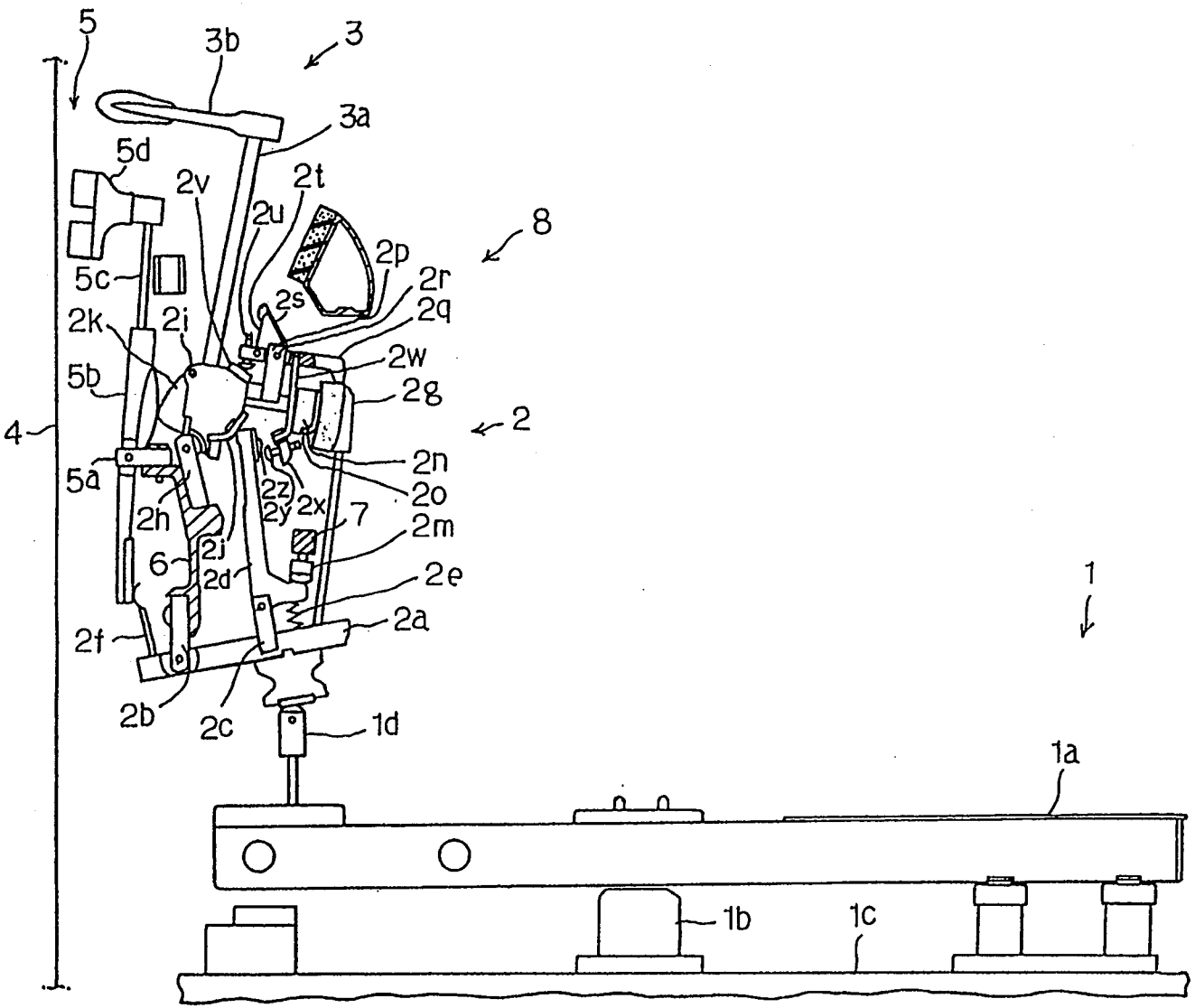
FIG. 4 is a side view showing the essential parts of the upright piano when the key action mechanism enters a back-checked state.
Figure 5:
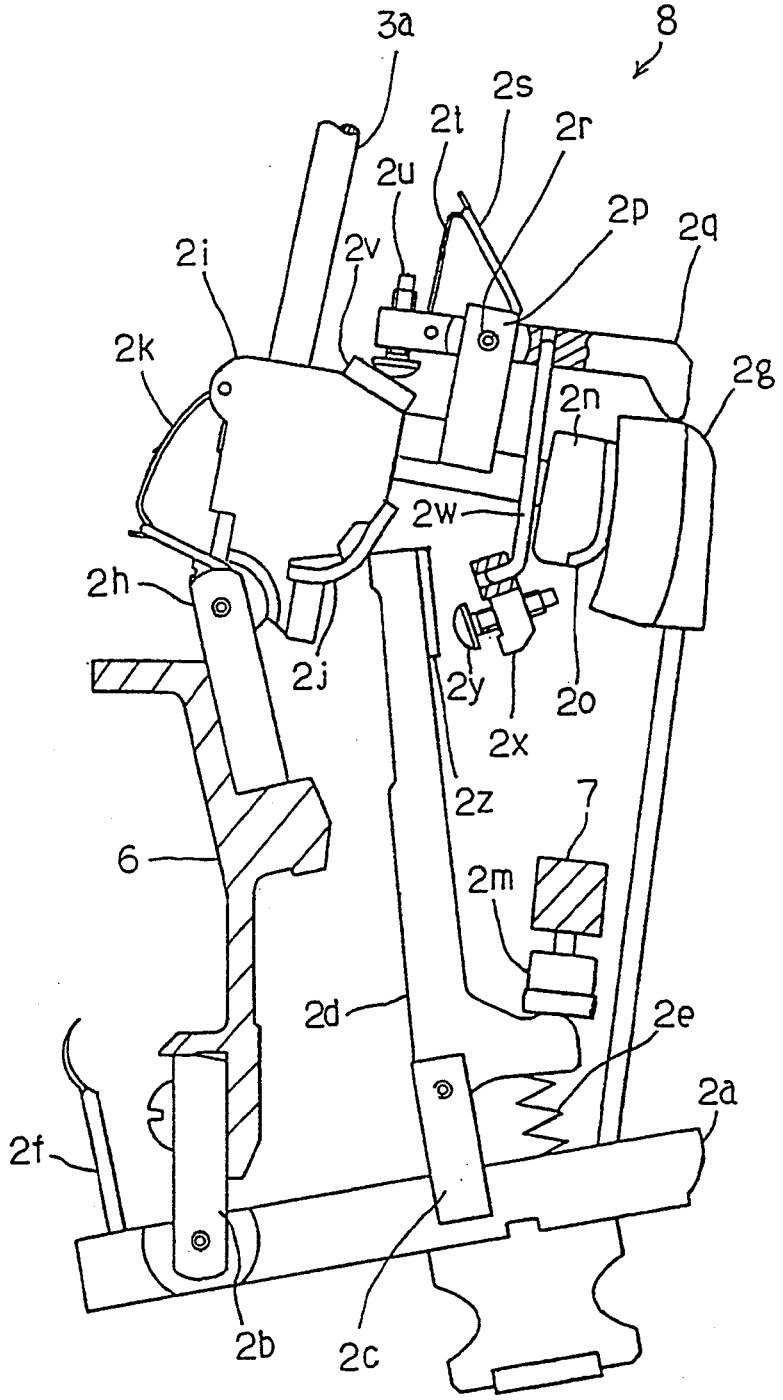
FIG. 5 is a side view showing, in an enlarged scale, the key action mechanism and the repetition mechanism in the back-checked state.
Figure 6:
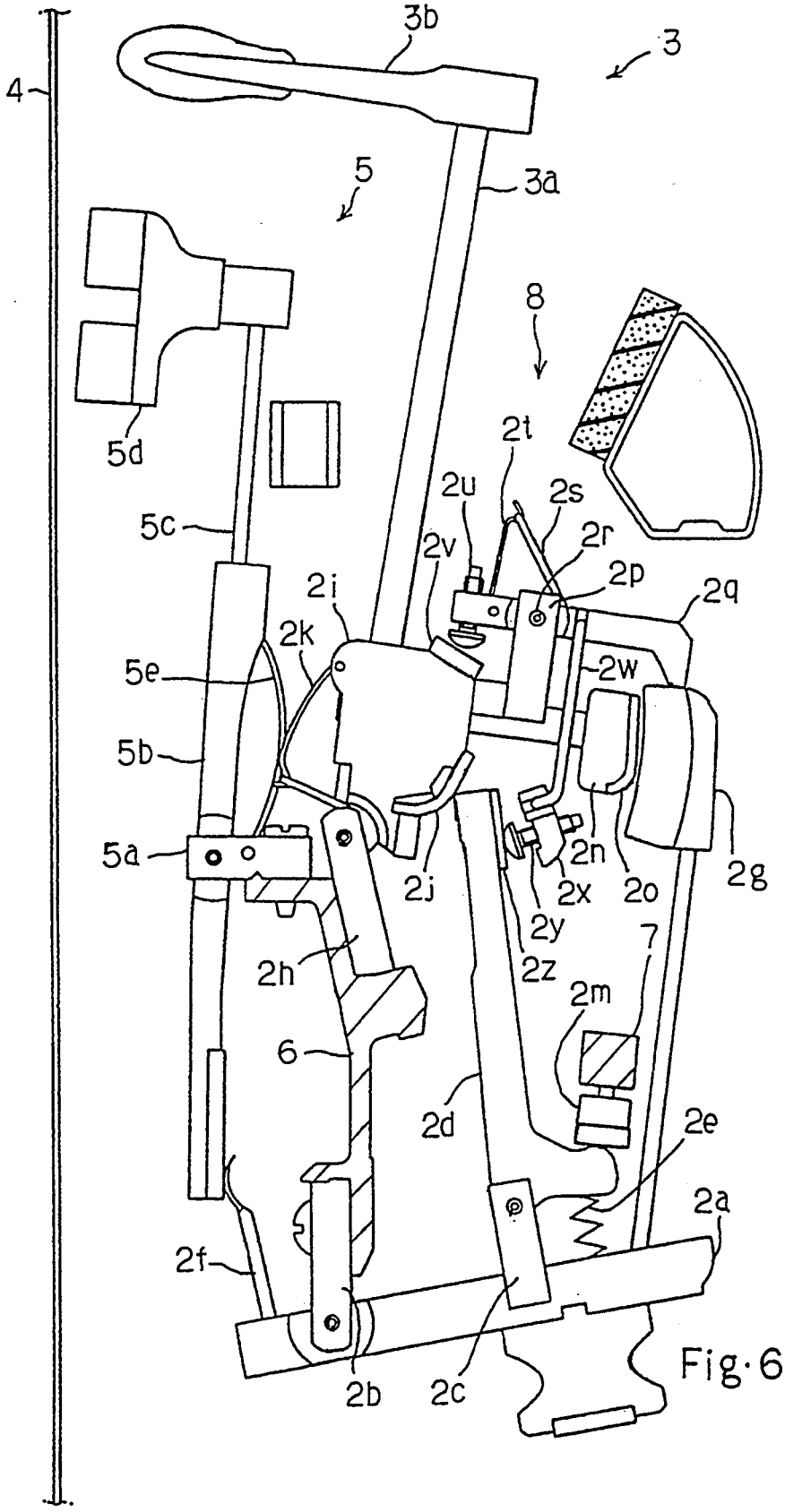
FIG. 6 is a side view showing the key action mechanism and the repetition mechanism in the suspended state after the key is softly depressed.

After the contact of the semi-spherical portion of the repetition lever 2*q* with the top of the back check felt, the catcher skin 2*o* is brought into contact with the left side surface of the back check felt, and the head of the regulating screw 2*y* is left from the jack cloth 2*z*. The key action mechanism 2 enters a suspended state shown in FIGS. 4 and 5. However, the catcher 2*n* never widely rebounds on the back check felt, because the impact at the hammer rebound is taken up through the rotation of the repetition lever 2*q* in the counter clockwise direction. The spring 2*t* accumulates part of the inertia in the form of resilient force. Therefore, the hammer head 3*b* never strikes the string 4 again.

In order to prevent the string 4 from double-strike, it is important to regulate the gap G to an appropriate value for allowing the hammer assembly 3 to rotate over the predetermined angle in the clockwise direction after striking the string 4 even if the key 1*a* is depressed slowly before the contact between the catcher skin 2*o* and the back check felt.

It is also important to adjust the distance between the head of the regulating screw 2*u* and the butt cloth 2*v* to an appropriate value when the key action mechanism enters the suspended state, because it determines the playing characteristics, for example, prevention of restriking or repetition characteristics. When the distance is too short, the impact at the butt rebounding from the strings 4 can not be taken up. Therefore, the hammer head 3*b* is liable to restrike the string 4. On the other hand, when the distance is too long, the impact is taken up completely, but the rotation range of the repetition lever 2*q* in the counter clockwise direction is so large that the response characteristics to the quick fingering is not improved.

When the key action mechanism 2 enters the suspended state, the key 1*a* have already reached the end position. If the player slightly lifts the key 1*a*, the whippen/whippen heel assembly 2*a* slightly rotates in the clockwise direction around the whippen flange 2*b*, and, accordingly, the back check 2*g* rotates in the clockwise direction. As a result, the back check felt is left from the catcher skin 2*o*.

The release of the catcher from the back check due to the rotation of the whippen/whippen heel assembly 2*d* in the clockwise direction allows the repetition lever 2*q* to rotate around the pin 2*p* in the clockwise direction due to the elastic force of the spring 2*t* so as to continue to be held in contact with the back check felt, and the reaction to the rotation of the repetition lever 2*q* rotates the flange 2*p* and, accordingly, the butt 2*i* in the counter clockwise direction. When the head of the regulating screw 2*y* is brought into contact with the jack cloth 2*z*, the repetition lever 2*q* and the butt 2*i* become stationary, because the regulating button 2*m* sets a limit on the jack 2*d*.

While the player is further lifting the key 1*a*, the whippen/whippen heel assembly 2*a* is also rotating in the clockwise direction around the whippen flange 2*b*, and the back check 2*g* is also rotating together with the whippen/whippen heel assembly 2*a*. This motion of the back check felt is equivalent to a sliding motion of the repetition lever 2*q* in the leftward direction with respect to the back check felt, because the rotation of the back check 2*g* is larger in the horizontal component than the vertical component. The repetition lever 2*q* is held in contact with the back check felt at the semi-spherical portion, and the sliding motion is smooth, Therefore, the hammer assembly rotates little in the clockwise direction.

When the key 1*a* is lifted from the end position by a predetermined distance, the toe of the jack 2*d* is spaced apart from the regulating button 2*m* through the rotation of the whippen/whippen heel assembly 2*a* in the clockwise direction, and, then, the jack spring 2*c* fully expands. Then, the jack 2*d* rapidly turns in the counter clockwise direction around the jack flange 2*c*, and returns beneath the butt skin 2*j*, because the semi-spherical portion of the repetition lever 2*q* is held in contact with the back check felt so that return of the hammer assembly 3 and, accordingly, the butt 2*i* is delayed.

Thus, before the butt 2*i* returns to the initial position shown in FIGS. 1 and 2, the jack 2*d* is brought into contact with the butt skin 2*o*, and the key action mechanism 2 enters ready for response to a key redepressing. Assuming now that the upright piano implementing the present invention is the same size as an ordinary upright piano, the key action mechanism 2 enters the ready for response to a key depressing when the key 1*a* is lifted from the end position by less than 3 millimeters. This means that the key action mechanism 2 is responsive to a quick repetition or a quick fingering.

Assuming now that the player softly depresses the key 1*a*, the key action mechanism 2 is responsive to the key depressing, and the hammer head 3*b* strikes the string 4 as described hereinbefore. However, the driving force exerted on the butt 2*i* by rebounding on the string 4 is so small that the reaction on the hammer assembly 3 can not exceed the elastic force of the spring 2*t*. In this situation, the key action mechanism 2 enters the suspended state when the repetition lever 2*q* is brought into contact with the upper surface of the back check felt, and the catcher skin 2*o* never contacts with the back check felt. Though the catcher 2*o* is never caught by the back check 2*g* due to the weak reaction, the hammer assembly does not strike the string 4 again, because the butt spring 2*k* urges the butt 2*i* in the clockwise direction, the back check felt takes up the impact and the repetition lever 2*q* is rotatably supported by the butt 2*i*.

As will be appreciated from the foregoing description, the key action mechanism 2 according to the present invention is responsive to a quick and strong repetition, because the jack 2*d* returns beneath the butt skin 2*j* before the key 1*a* reaches the rest position.

The key action mechanism 2 does not press the hammer head 3*b* against the string 4 even if the player softly depresses the key 1*a*, because the gap is produced between the semi-spherical portion of the repetition lever 2*q* and the back check felt when the jack 2*d* is escaped from the butt 2*i* but before the hammer assembly 3 rotates in the clockwise direction. Therefore, the butt 2*i* and, accordingly, the hammer assembly 3 can rotate voer the predetermined angle in the clockwise direction due to the gap after the escape of the jack 2*d*.

The key action mechanism 2 never allows the hammer head 3*b* to strike the string 4 twice even if the player softly depresses the key 1*a*, because the butt spring 2*k* urges the butt 2*i* in the clockwise direction, the back check felt takes up the impact and the repetition lever 2*q* is rotatably supported by the butt 2*i*.

Moreover, the key action mechanism 2 is easily regulated, especially, in the adjusting the regulating button 2*m*, because the repetition lever 2*q* is pushed up over the back check felt through the rotation of the jack 2*d* due to the escape without any contact with the back check 2*g* for allowing the hammer assembly 3 to slightly move in the clockwise direction. Therefore, the tuner can discriminate the timing when the hammer assembly 3 being approached to the string 4 by the jack slightly returns due to the gap G after escape of the jack 2*d*, and the tuner can adjust the distance between the hammer head 3*b* and the string 4 to the predetermined value at that timing.

Second Embodiment

Figure 7:
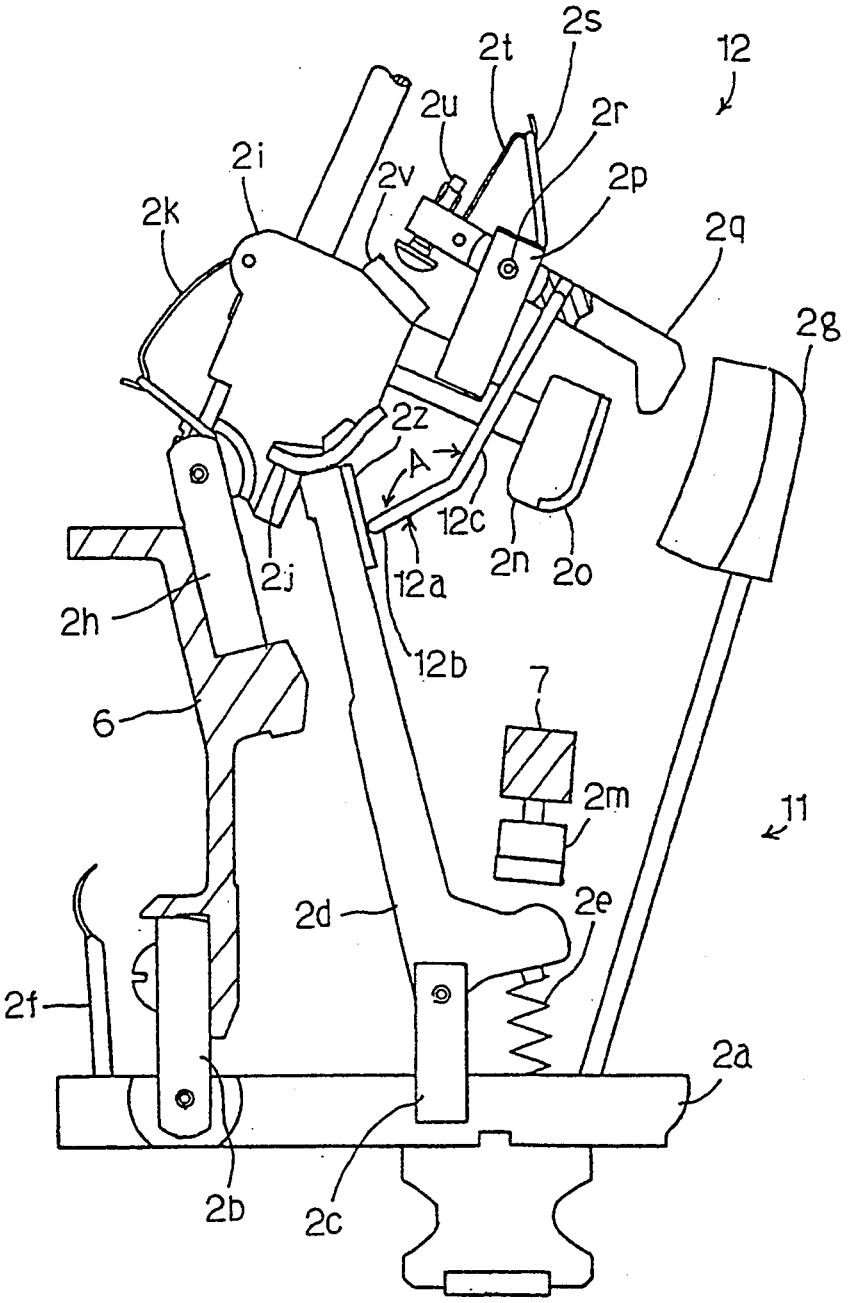
FIG. 7 is a side view showing a repetition mechanism incorporated in another upright piano according to the present invention.

Turning to FIG. 7 of the drawings, a key action mechanism 11 is accompanied with a repetition mechanism 12, and the key action mechanism 11 and the repetition mechanism 12 form parts of an upright piano embodying the present invention. Though not shown in FIG. 7, an associated key is staying in the rest position, and the key action mechanism 11 and the repetition mechanism 12 remain in respective initial positions. However, the upright piano implementing the second embodiment is only different in the structure of the repetition mechanism 12 from the first embodiment, and the other components are labeled with the same references designating the corresponding components of the first embodiment without detailed description.

In the repetition mechanism 12, the rod member 2*w*, the block member 2*x* and the regulating screw 2*y* are replaced with a deformable rod member 12*a*. However, the other component parts are similar to those of the first embodiment, and are labeled with the same references without any detailed description.

The deformable rod member 12*a* is bent at an intermediate portion, and the leading end portion 12*b* is directed at angle A with respect to the boss portion 12*c*. In a regulating, a tuner changes the angle A, and the initial position of the repetition lever 2*q* is regulable.

The upright piano implementing the second embodiment achieves all the advantages of the first embodiment.

Third Embodiment

Figure 8:
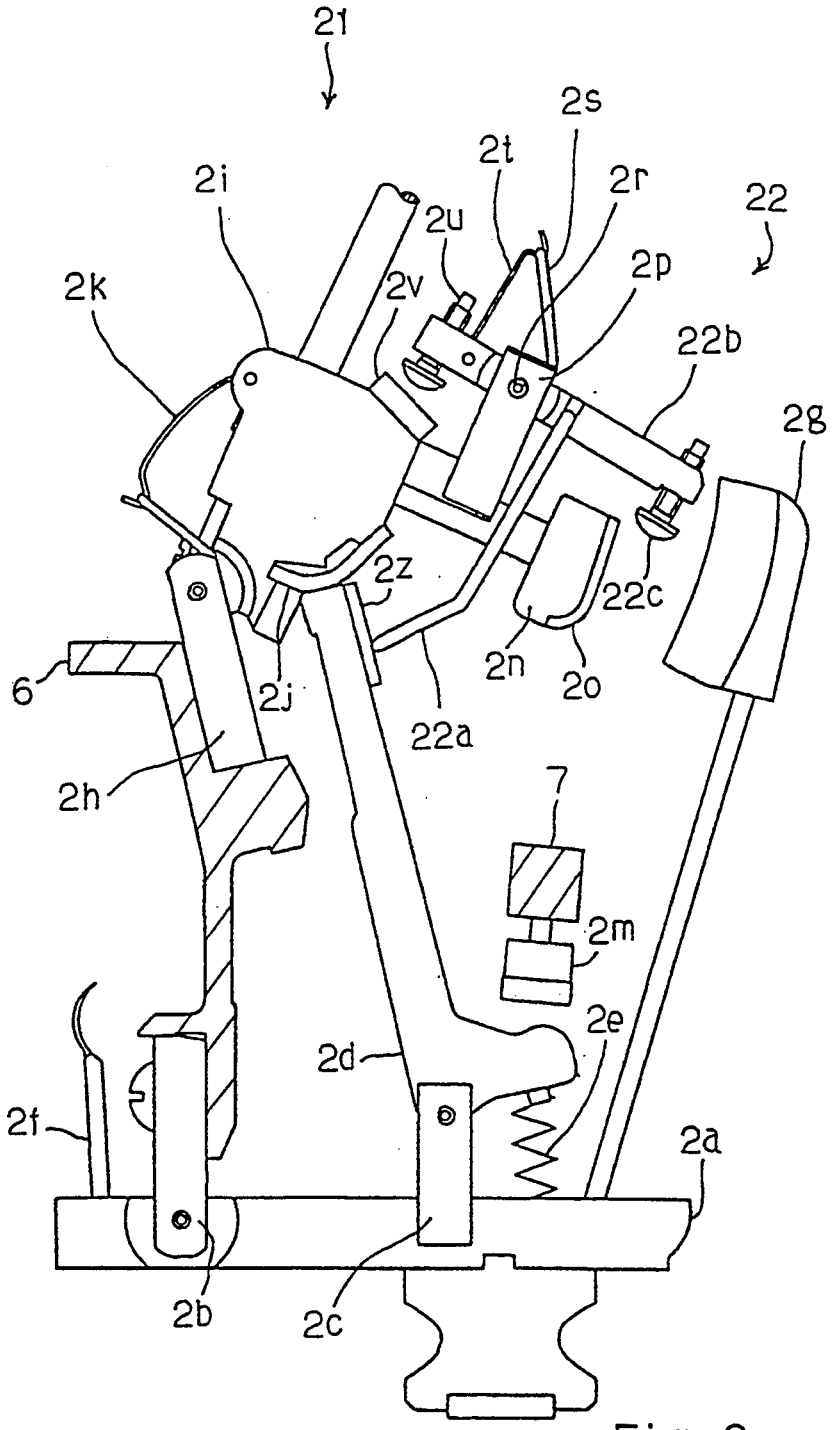
FIG. 8 is a side view showing a repetition mechanism incorporated in yet another upright piano according to the present invention.

Turning to FIG. 8 of the drawings, a key action mechanism 21 is accompanied with a repetition mechanism 22, and the key action mechanism 21 and the repetition mechanism 22 form parts of an upright piano embodying the present invention. Though not shown in FIG. 8, an associated key is staying in the rest position, and the key action mechanism 21 and the repetition mechanism 22 remain in respective initial positions. However, the upright piano implementing the third embodiment is only different in the structure of the repetition mechanism 22 from the first embodiment, and the other components are labeled with the same references designating the corresponding components of the first embodiment without detailed description.

In the repetition mechanism 22, the rod member 2*w*, the block member 2*x* and the regulating screw 2*y* are replaced with a deformable rod member 22*a*, and the deformable rod member 22*a* is similar to the deformable rod member 12*a* of the second embodiment. Moreover, the repetition lever 2*q* is replaced with a repetition lever 22*b*, and a regulating screw 22*c* is engaged with the right end portion of the repetition lever 22*b* instead of the semi-spherical portion. However, the other component parts are similar to those of the first embodiment, and are labeled with the same references without any detailed description.

In a regulating, the regulating screw 22*c* is screwed into or out of the right end portion, and, after the escape of jack 2*d*, the gap between the head of the screw 22*c* and the back check felt is regulated to an appropriate value without any deformation of the rod 22*a*.

The upright piano implementing the third embodiment achieves all the advantages of the first embodiment.

Fourth Embodiment

Figure 9:
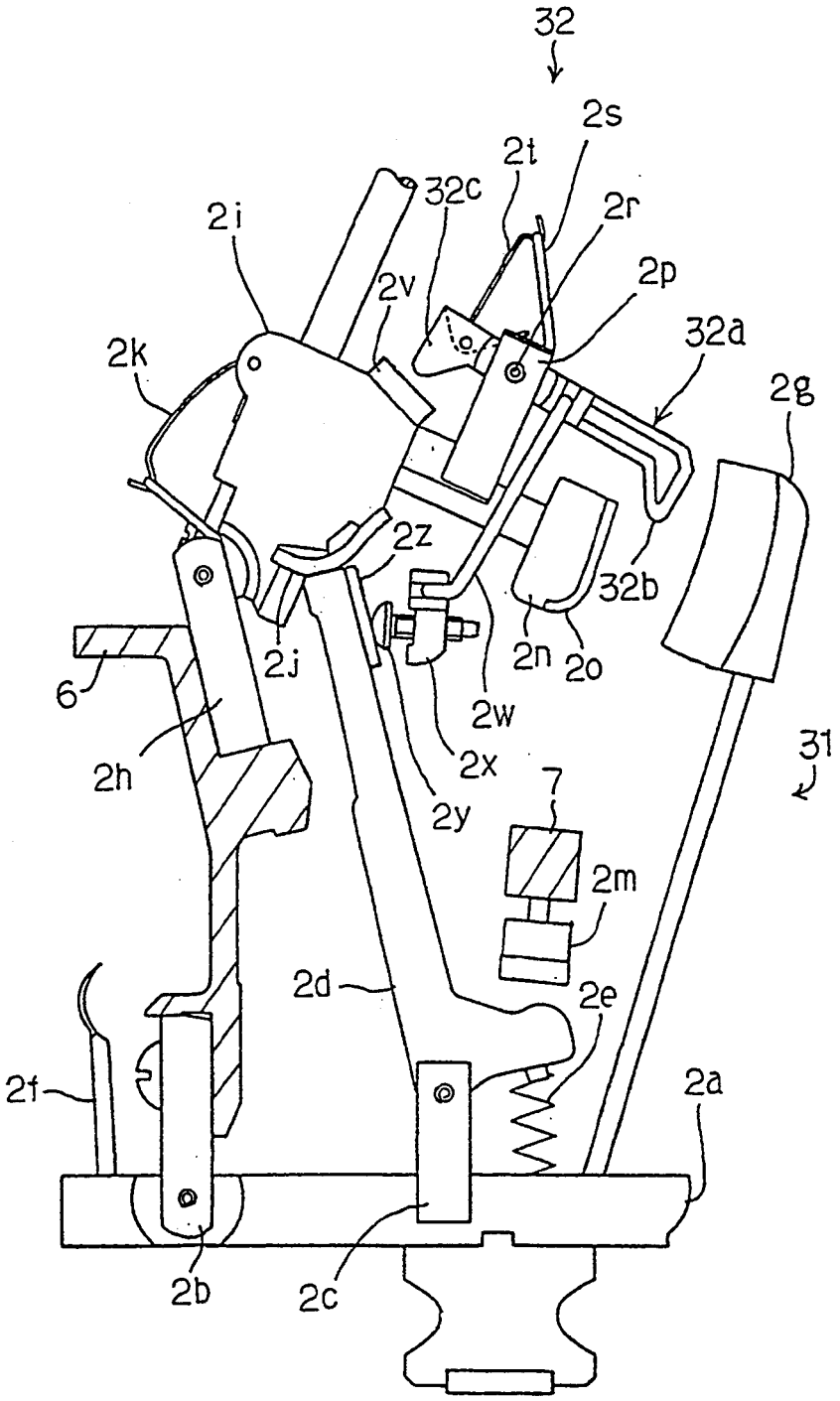
FIG. 9 is a side view showing a repetition mechanism incorporated in still another upright piano according to the present invention.

Turning to FIG. 9 of the drawings, a key action mechanism 31 is accompanied with a repetition mechanism 32, and the key action mechanism 31 and the repetition mechanism 32 form parts of an upright piano embodying the present invention. Though not shown in FIG. 9, an associated key is staying in the rest position, and the key action mechanism 31 and the repetition mechanism 32 remain in respective initial positions. The upright piano implementing the fourth embodiment is only different in the structure of the repetition mechanism 32 from the first embodiment, and the other components are labeled with the same references designating the corresponding components of the first embodiment without detailed description.

In the repetition mechanism 32, the repetition lever 2*q* is replaced with a repetition lever 32*a*, and semi-spherical portions 32*b* and 32*c* are formed in both end portions of the repetition lever 32*a*. However, the other component parts are similar to those of the first embodiment, and are labeled with the same references without any detailed description.

The semi-spherical portion 32*b* makes sliding motion on the back check felt smooth. Though the rotation range of the repetition lever 32*a* can not be regulated, the height of the semi-spherical portion 32*c* is determined to an optimum value. Therefore, there is not problem in playing characteristics.

The upright piano implementing the fourth embodiment achieves all the advantages of the first embodiment.

Although particular embodiments of the present invention have been shown and described, it will be obvious to those skilled in the art that various changes and modifications may be made without departing from the spirit and scope of the present invention. For example, various types of spring are available for the spring 2*t*, and each of the regulating screws 2*u* and 2*y* is replaceable with washers fixed between a bolt and a nut.

Moreover, an upright piano according to the present invention may form a part of an automatic player piano disclosed in, for example, U.S. Pat. No. 4,913,026, and a music is reproduced through a playback mode of operation on the upright piano.

Another upright piano may be equipped with an electronic tone generating system coupled with a speaker system and a shank stopper. In this instance, the shank stopper is moved into or out of the orbits of the hammer assemblies depending upon the modes of operation. While the upright piano is staying in a silent mode, the hammer assemblies driven by the associated key action mechanisms are brought into contact with the shank stopper before strike at the strings, and the tone generating system synthesizes sounds instead of the strings.

What is claimed is:

1. An upright piano comprising:

a) a keyboard having at least one key swingable between a rest position without any force and an end position, a capstan button projecting from a rear portion of said at least one key;

b) at least one string associated with said at least one key;

c) at least one hammer assembly for striking said at least one string;

d) a key action mechanism linked with said at least one key for driving said at least one hammer assembly, and having d-1) a whippen assembly pivotaly supported by a stationary structure, and rotated by said capstan button between a first initial position corresponding to said rest position and a first terminal position corresponding to said end position through a first intermediate position, d-2) a jack pivotaly supported by said whippen assembly, and moved from a second initial position to a restricted position without any pivotal motion when said whippen assembly is swung from said first initial position to said first intermediate position, said jack being rotated around said whippen assembly from said restricted position through an escape position to a second terminal position when said whippen assembly is rotated from said first intermediate position to said first terminal position, d-3) a butt pivotaly supported by said stationary structure, and connected with said hammer assembly, said butt being rotated by said jack in a forward direction from a third initial position corresponding to said second initial position to a released position corresponding to said escape position, said butt being kicked by said jack at said released position for rushing said at least one hammer assembly toward said at least one string, said at least one hammer assembly rebounding on said at least one string so that said butt being rotated in a backward direction through a second intermediate position to a third terminal position, d-4) a back check projecting from said whippen assembly, and d-5) a catcher backwardly projecting from said butt, and brought into contact with said back check when said butt reaches said third terminal position; and e) a repetition mechanism having e-1) a repetition lever rotatably supported by said butt, and rotated by said jack due to the escape so as to produce a gap between a leading end thereof and said back check when said jack reaches said second terminal position and before said at least one hammer assembly rotates backwardly, then said leading end being brought into contact with said back check when said butt reaches said second intermediate position, e-2) a driving rod means projecting from said repetition lever, brought into contact with said jack, and rotating said repetition lever over said back check on the way from said escape position to said second terminal position through the rotation of said jack due to the escape, and e-3) an elastic means urging said repetition lever for allowing said driving rod means to be brought into contact with said jack.

2. An upright piano as set forth in claim 1, in which said driving rod means comprises a rod member projecting from said repetition lever, and a regulating means coupled with a leading end of said rod member and changing an initial position of said repetition lever, thereby regulating said gap between the leading end of said repetition lever and said back check to an appropriate value when said jack reaches said second terminal position and before said at least one hammer assembly rotates backwardly.

3. An upright piano as set forth in claim 1, in which said repetition mechanism further comprises e-4) a bracket member fixed to said butt and pivotaly supporting said repetition lever, and e-5) a regulating means coupled with the rear end of said repetition lever and changing a rotation range of said repetition lever by changing a gap between the rear end of said repetition lever and said butt when said at least one hammer assembly reaches said third terminal position.

4. An upright piano as set forth in claim 3, in which said elastic means comprises a rigid member projecting from said bracket member, and a spring member coupled between said rigid member and a rear end portion of said repetition lever.

5. An upright piano as set forth in claim 1, in which said leading end of said repetition lever is shaped into a semi-spherical configuration so as to decrease friction on said back check.

6. An upright piano as set forth in claim 1, in which the rear end portion of said repetition lever is shaped into a semi-spherical configuration.

7. An upright piano as set forth in claim 1, in which said driving rod means comprises a rod member projecting from said repetition lever, a block member fixed to a leading end portion of said rod member, and a bolt member screwed into and out of said block member.

8. An upright piano as set forth in claim 1, in which said driving rod means comprises a deformable rod member projecting from said repetition lever.

9. An upright piano as set forth in claim 8, in which a regulating means is coupled with the leading end of said repetition lever, thereby regulating a gap between said regulating means and said back check to an appropriate value when said jack reaches said second terminal position and before said at least one hammer assembly rotates backwardly.

* * * * *